US009689128B2

(12) United States Patent
Gu et al.

(10) Patent No.: US 9,689,128 B2
(45) Date of Patent: Jun. 27, 2017

(54) ARTIFICIAL DAM OF DISTRIBUTED COAL MINE UNDERGROUND RESERVOIR AND ITS CONSTRUCTING METHOD

(71) Applicant: CHINA SHENHUA ENERGY COMPANY LIMITED, Beijing (CN)

(72) Inventors: Dazhao Gu, Beijing (CN); Quansheng Li, Beijing (CN); Sushe Chen, Beijing (CN); Zhiguo Cao, Beijing (CN)

(73) Assignee: CHINA SHENHUA ENERGY COMPANY LIMITED, Beijing (CN)

( * ) Notice: Subject to any disclaimer, the term of this patent is extended or adjusted under 35 U.S.C. 154(b) by 0 days.

(21) Appl. No.: 14/910,134

(22) PCT Filed: Apr. 10, 2014

(86) PCT No.: PCT/CN2014/075083
§ 371 (c)(1),
(2) Date: Feb. 4, 2016

(87) PCT Pub. No.: WO2015/021782
PCT Pub. Date: Feb. 19, 2015

(65) Prior Publication Data

US 2016/0201460 A1 Jul. 14, 2016

(30) Foreign Application Priority Data

Aug. 14, 2013 (CN) ..... 2013 1 0354286

(51) Int. Cl.
*E21F 17/00* (2006.01)
*E21F 17/16* (2006.01)
(Continued)

(52) U.S. Cl.
CPC ..... *E02B 3/10* (2013.01); *E21F 17/00* (2013.01); *E21F 17/103* (2013.01); *E21F 17/16* (2013.01)

(58) Field of Classification Search
CPC ..... E21F 17/00; E21F 17/103; E21F 17/16
(Continued)

(56) References Cited

U.S. PATENT DOCUMENTS 3,396,539 A * 8/1968 Khan ..... E21F 17/16 405/53
3,469,405 A * 9/1969 Reinhold ..... E02D 5/18 299/11
(Continued)

FOREIGN PATENT DOCUMENTS

CN 2918533 Y 7/2007
CN 202047397 U 11/2011
(Continued)

OTHER PUBLICATIONS

International Search Report of International Application No. PCT/CN2014/075083, Jul. 9, 2014, 4 pages.
(Continued)

*Primary Examiner* — Frederick L Lagman
(74) *Attorney, Agent, or Firm* — Armstrong Teasdale LLP

(57) ABSTRACT

The present disclosure provides an artificial dam of a distributed coal mine underground reservoir and its constructing method. The artificial dam comprises a support layer (10), an anti-seepage layer (20), and a concrete structure layer (30) that are successively formed in an auxiliary roadway (1) from inside to outside, the concrete structure layer (30) being embedded into a security coal pillar (2) and/or surrounding rock (3) around the auxiliary roadway (1). Because the concrete structure layer (30) is embedded into the security coal pillar (2) and/or the surrounding rock (3) around the auxiliary roadway (1), the artificial dam is combined to the security coal pillar (2) to together form a dam for an underground reservoir. Due to multi-layer design, anti-seepage performance and structural strength of
(Continued)

the dam can meet the water storage requirements of the underground reservoir.

11 Claims, 3 Drawing Sheets

(51) Int. Cl.
*E21F 17/103* (2006.01)
*E02B 3/10* (2006.01)

(58) Field of Classification Search
USPC ..... 405/53, 55; 299/10, 11, 12
See application file for complete search history.

(56) References Cited

U.S. PATENT DOCUMENTS

| | | | | | |
|---|---|---|---|---|---|
| 3,583,165 | A * | 6/1971 | West | E21F 15/00 | 405/266 |
| 4,102,138 | A * | 7/1978 | Dreker | E21F 17/107 | 299/12 |
| 4,315,657 | A * | 2/1982 | Burton, III | E21F 17/103 | 299/19 |
| 4,712,945 | A * | 12/1987 | Schrimpf | E21F 17/103 | 299/12 |
| 4,784,522 | A * | 11/1988 | Mraz | E21F 17/103 | 299/11 |
| 4,818,144 | A * | 4/1989 | Mraz | E21F 17/103 | 299/12 |
| 5,782,539 | A * | 7/1998 | Peterson | E21C 41/18 | 299/11 |
| 6,082,828 | A * | 7/2000 | Bailey | E21F 17/103 | 299/12 |
| 8,342,776 | B2 * | 1/2013 | Watson | E21F 17/103 | 299/12 |
| 8,777,522 | B2 * | 7/2014 | Watson | E21F 17/103 | 299/11 |
| 2011/0013991 | A1 * | 1/2011 | Watson | E21F 17/103 | 405/284 |

FOREIGN PATENT DOCUMENTS

| | | | | | |
|---|---|---|---|---|---|
| CN | 102661169 | A | * | 9/2012 | |
| CN | 102767302 | A | | 11/2012 | |
| CN | 103422886 | A | | 12/2013 | |
| CN | 203412629 | U | | 1/2014 | |
| CN | 203412696 | U | | 1/2014 | |
| CN | 105421161 | A | * | 3/2016 | |
| DE | 3147639 | A1 | * | 9/1982 | E21F 17/16 |
| EA | 200802025 | A1 | | 8/2009 | |
| GB | 191310483 | A | * | 0/1913 | E21F 17/103 |
| JP | H07156992 | A | | 6/1995 | |
| RU | 2219350 | C1 | | 12/2003 | |
| SU | 416440 | A1 | | 2/1974 | |
| SU | 726349 | A1 | | 4/1980 | |
| SU | 840411 | A1 | | 6/1981 | |

OTHER PUBLICATIONS

Office Action of Russian Patent Application No. 2016103785/03 (005989), Jul. 1, 2016, 6 pages.

* cited by examiner

I-I

ARTIFICIAL DAM OF DISTRIBUTED COAL MINE UNDERGROUND RESERVOIR AND ITS CONSTRUCTING METHOD

TECHNICAL FIELD

The present disclosure relates to coal mining and hydraulic engineering, and particularly an artificial dam of distributed coal mine underground reservoir and its constructing method.

BACKGROUND ART

In China, Shanxi Province, Shaanxi Province, Inner Mongolia, Ningxia Province, and Gansu Province constitute an energy "Golden Triangle" region. The coal resource of the energy "Golden Triangle" region is characterized by shallow depth of embedment, thin bedrock, and thick coal seam, etc. In 2011, the coal production of this area reached 2.382 billion tons, accounting for 67.7% of the overall coal production in China. This area has become a major coal production area of China. However, the energy "Golden Triangle" region in western China has a fragile ecosystem. This region is exceptionally dry with scare and the water resource thereof is unevenly distributed, by location and season. For instance, the northern part of Shaanxi province is an inland area with little rainfall and high evaporation, and its per capita water resource is merely 927 $m^3$, accounting for 35.7% of the average water resource per capita in China. Therefore, the northern part of Shaanxi province is a typical region with a severe water-shortage.

It is unavoidable that large-scale and intensive coal mining in this region will have negative impact on water resources in this region. The movement and storage state of surface and underground water can be affected by coal mine roadways and goafs, the circulation of the underground water has been changed, for example, dried-up river streams, decline of water table, and drastic decrease or drying up of spring-water. Water conservation, therefore, is recognized as the key to sustainable development in the energy "Golden Triangle" region. However, conventional water conservation technologies (such as backfill mining, height-limited mining) are not easy to implement in this region due to the constraint of the geological storage conditions of coal seams in this region. It is necessary to develop new technologies to protect and utilize water resource in this region. Currently, an important technology is to drain mine water. However, drainage of mine water has numerous disadvantages, one of which is to produce extreme waste of water resource, and another of which is to cause pollution produced by the mine water being drained to the ground surface. Moreover, because it is arid in the energy "Golden Triangle" region, evaporation occurs rapidly and most drained water will evaporate before it can be effectively utilized.

Therefore, the key challenge related to water-preserving mining in the energy "Golden Triangle" region is how to prevent the mine water being drained. Goafs formed by underground mining can be used to store mine water. If this storage is supplemented by engineering measures for storing mine water resources, the stored water can be utilized by drilling holes, which connect the reservoirs to the ground surface. If so, the water resources can be used effectively in the future. Multiple goafs for storing water are communicated with each other through coal mine roadways or pipes, so as to form a communicated underground space for storing water, i.e., a distributed coal mine underground reservoir. Dam-constructing is important for the distributed coal mine underground reservoir and ensures the safety of water storage. Meanwhile, by constructing an artificial dam, the multiple goafs are connecting and thus constituted a greater water storage space. By taking advantage of the height difference between the goafs, free flow of the mine water in the reservoir and purifying of the mine water are achieved.

Currently, there are no references on building an artificial dam of distributed coal mine underground reservoir. Some regulations in China, e.g. "Safety Regulations in Coal Mine" and "Provisions on Prevention and Control of Water in Coal Mines", prescribe constructing of sluice gates and sluice walls. But, these regulations mainly focus on prevention and control of water disaster, and do not relate to the underground reservoir storing water. In aspect of water conservancy project, the regulations in China prescribe, in detail, the dam-building of a ground surface reservoir which is substantially different from that of an underground reservoir. Therefore, it is of great significance for constructing an artificial dam for distributed coal mine underground reservoir.

SUMMARY

It is an object of the present disclosure to provide an artificial dam of coal mine underground reservoir with simple structure and stable performance, and a constructing method.

A technical solution of the present disclosure is to provide an artificial dam for distributed coal mine underground reservoir, wherein the artificial dam comprises a support layer, an anti-seepage layer, and a concrete structure layer, which are successively formed in an auxiliary roadway from inside to outside, wherein the concrete structure layer is embedded into security coal pillars and/or surrounding rocks around the auxiliary roadway.

Preferably, the concrete structure layer is embedded into the security coal pillars and/or the surrounding rocks in the depth of 30-80 cm.

Preferably, multiple bolts are provided between the concrete structure layer and the security coal pillars and/or the surrounding rocks.

Preferably, the length of the bolts is 180-210 cm, and the depth of the bolts inserted into the security coal pillars and/or the surrounding rocks is 30-80 cm.

Preferably, multiple joist steels are embedded into the concrete structure layer, and constitute a shape of "#".

Preferably, the support layer is a brick and concrete structure layer with a thickness of 1.5 m.

Preferably, the anti-seepage layer is a gangue structure layer or loess structure layer with a thickness of 2 m.

Preferably, a cross section of the artificial dam is rectangular or arc-shaped, and a concave of the artificial dam with arc-shaped cross section faces the underground reservoir.

Preferably, emergency-observing holes are provided in the support layer, the anti-seepage layer, and the concrete structure layer.

Another technical solution of the present disclosure is to provide a method for constructing an artificial dam of distributed coal mine underground reservoir, wherein the method comprises the steps of: selecting positions for constructing the artificial dam between security coal pillars in an auxiliary roadway; in the auxiliary roadway, successively forming a support layer and an anti-seepage layer from inside to outside; abutting outside of the anti-seepage layer, notching in the security coal pillars and/or surrounding rocks around the auxiliary roadway, to form recesses; in the recesses, inserting multiple bolts into the security coal pillars and/or the surrounding rocks; embedding joist steels into the recesses; and ejecting concrete with high pressure to form a concrete structure layer in the recesses.

Preferably, the step of "selecting positions for constructing the artificial dam" comprises: prospecting rock-coal properties, stratums, and structures of roadways to be constructed by using geophysical prospecting and drilling means; and selecting locations with simple structure and stable rock-coal property as constructing sites of the artificial dam.

Preferably, before the step of in the auxiliary roadway, successively forming a support layer and an anti-seepage layer, the method further comprises: estimating water pressure in the auxiliary roadway; and setting a shape of a cross section of the artificial dam according to the water pressure.

The present disclosure has the following advantages: since the concrete structure layer is embedded into the security coal pillars and/or the surrounding rocks around the auxiliary roadway, the artificial dam and the security coal pillars together form the dam for the underground reservoir. The anti-seepage performance and the structural strength can meet the requirement of water storage of the underground reservoir due to the multiple-layer design.

REFERENCE NUMBER LIST

1—auxiliary roadway
2—security coal pillar
3—surrounding rock
4—goaf
5—main roadway
11—haulage roadway
12—ventilation roadway
13—connecting roadway
10—support layer
20—anti-seepage layer
30—concrete structure layer
31—bolt
32—joist steel
33—recess

DETAILED DESCRIPTION OF THE EMBODIMENTS

Hereinafter, the embodiments of the present disclosure are further described with reference to the accompanying drawings.

Figure 1:
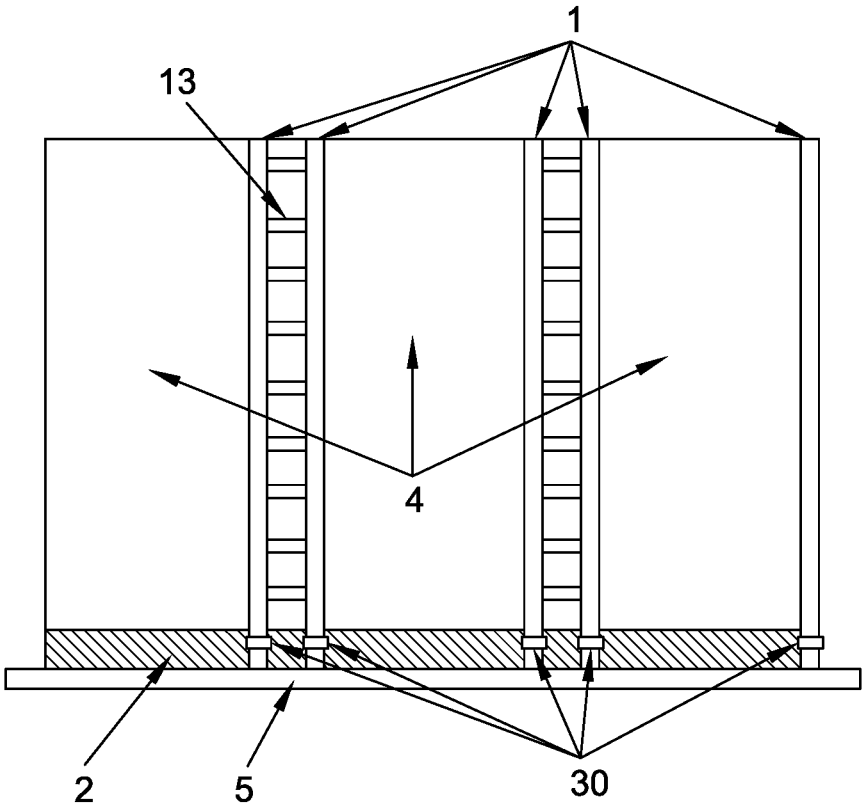
FIG. 1 is a structural diagram of a distributed coal mine underground reservoir according to an embodiment of the present disclosure.

As shown in FIG. 1, security coal pillars 2 are portions of ore bodies which are not mined temporarily or are preserved for protecting ground surface landforms, buildings, constructions and major roadways from collapsing, and for isolating ore fields, coalfields, aquifers, fire zones, fracture zones, etc. The security coal pillars 2 play a supporting role, and are located on left and right sides of an auxiliary roadway 1. Surrounding rocks 3 (see FIG. 3) are formed while the auxiliary roadway 1 is being drilled. The surrounding rocks 3 are located on upper and lower sides of the auxiliary roadway 1. The auxiliary roadway 1 comprises a haulage roadway 11 and a ventilation roadway 12, and the haulage roadway 11 and the ventilation roadway 12 are communicated by a connecting roadway 13. When coals are mined, the haulage roadway 11 plays a haulaging role, and the ventilation roadway 12 plays an air-ventilating role. A goaf 4 is formed between the haulage roadway 11 and the ventilation roadway 12 after a mining face is mined. Then, overlying strata of the auxiliary roadway 1 caves, and the auxiliary roadway 1 and the goaf 4 together form an underground reservoir. In the present disclosure, security coal pillars 2 are located between the underground reservoir and a main roadway 5, and a portion of dam body of the underground reservoir is formed by security coal pillars 2. Since the auxiliary roadway 1 is communicated with the main roadway 5, only positions between the auxiliary roadway 1 and the main roadway 5 need to be plugged.

Figure 2:
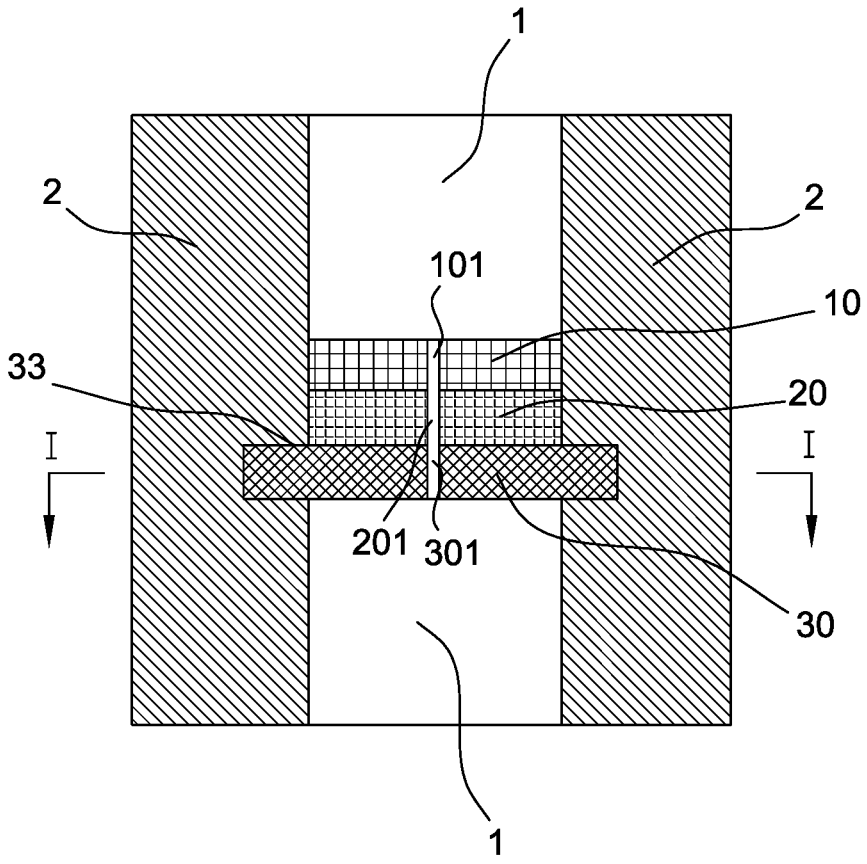
FIG. 2 is a structural diagram of an artificial dam according to an embodiment of the present disclosure.

As shown in FIG. 2, an artificial dam for distributed coal mine underground reservoir in the present disclosure comprises: a support layer 10, an anti-seepage layer 20, and a concrete structure layer 30, which are successively formed in the auxiliary roadway 1 from inside to outside, wherein the concrete structure layer 30 is embedded into the security coal pillars 2 and the surrounding rocks 3 around the auxiliary roadway 1. In the present embodiment, the support layer 10 is a brick and concrete structure layer with a thickness of 1.5 m, the anti-seepage layer 20 is a gangue structure layer or loess structure layer with a thickness of 2 m, the thickness of the concrete structure layer 30 is 1.5 m, and thus the total thickness of the artificial dam is 5 m.

In the present disclosure, the term "inside" refers to the side adjacent to the underground reservoir, and the term "outside" refers to the side adjacent to the main roadway 5. From inside to outside, the first layer (i.e. the brick and concrete structure layer) blocks water and supports upper surrounding rocks 3; the second layer (i.e. the gangue or loess structure layer) forms a relatively airtight wall structure by means of gangue and loess, which plays an anti-seepage role and saves the cost of the artificial dam, as the second layer uses the waste produced in coal mining. The concrete structure layer 30 has an excellent anti-seepage performance, and it is more important that the concrete structure layer 30 is embedded into the security coal pillars 2 on left and right sides of the auxiliary roadway 1 and the surrounding rocks 3 on upper and lower sides of the auxiliary roadway 1, so as to improve the strength of the artificial dam.

Preferably, the thickness of the brick and concrete structure layer is not limited to 1.5 m, the thickness of the gangue structure layer or loess structure layer is not limited to 2 m, and the thickness of the concrete structure layer 30 is not limited to 1.5 m.

Preferably, anti-seepage material (such as luokexiu) may be added to the gangue structure layer or loess structure layer, to improve the anti-seepage performance of the artificial dam.

Preferably, the concrete structure layer 30 may only be embedded into the security coal pillars 2, or the concrete structure layer 30 may only be embedded into the surrounding rocks 3.

Figure 3:
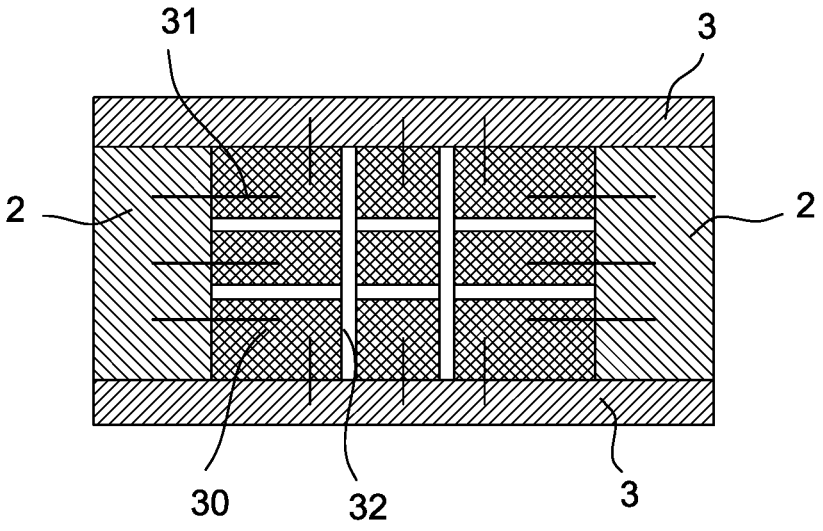
FIG. 3 is a cross sectional view taking along A-A of FIG. 2.

In the present embodiment, as shown in FIG. 3, the concrete structure layer 30 is embedded into the security coal pillars 2 and the surrounding rocks 3 in the depth of 30-80 cm. Specifically, the concrete structure layer 30 may be embedded into the security coal pillars 2 in the depth of 50-80 cm, and the concrete structure layer 30 may be embedded into the surrounding rocks 3 in the depth of 30-60 cm. There are three bolts 31 between the concrete structure layer 30 and the security coal pillar 2, and there are also three bolts 31 between the concrete structure layer 30 and the surrounding rock 3. The number of the bolts 31 may also be more than three. Multiple bolts 31 are spaced apart from one another. The distance between adjacent bolts 31 can be 20 cm. The length of one bolt 31 is 180-210 cm. The depth of the bolts 31 inserted into the security coal pillars 2 and the surrounding rocks 3 is 30-80 cm. Specifically, the depth of the bolts 31 inserted into the security coal pillars 2 may be 50-80 cm, and the depth of the bolts 31 inserted into the surrounding rocks 3 may be 30-60 cm. The bolts 31 should keep upright, so as to ensure good stability. The bolts 31 may be supported by steel bars, for connecting the artificial dam 30 with the security coal pillars 2 or the surrounding rocks 3, which improves the strength of the artificial dam.

Preferably, the bolts 31 may only be constructed between the security coal pillars 2 and the concrete structure layer 30, or the bolts 31 may only be constructed between the surrounding rocks 3 and the concrete structure layer 30. It is possible that, the concrete structure layer 30 is embedded into the security coal pillars 2, and the bolts 31 are inserted between the concrete structure layer 30 and the surrounding rocks 3. Alternatively, the concrete structure layer 30 may be embedded into the surrounding rocks 3 and the bolts 31 are inserted between the concrete structure layer 30 and the security coal pillars 2.

In the present embodiment, as shown in FIG. 3, joist steels 32 are provided in the concrete structure layer 30. In the whole concrete structure layer 30, multiple joist steels 32 constitute a shape of "#", wherein the length of the longitudinally-oriented joist steels 32 is equal to the height of the concrete structure layer 30, and the length of the transversely-oriented joist steels 32 is equal to the width of the concrete structure layer 30. The joist steels can improve the strength of the artificial dam to resist against the water pressure of the underground reservoir.

Preferably, the multiple joist steels 32 may also constitute other shapes, such as a shape of "*" or a cross shape, in the concrete structure layer.

In the present embodiment, the cross section of the artificial dam is rectangular.

Figure 4:
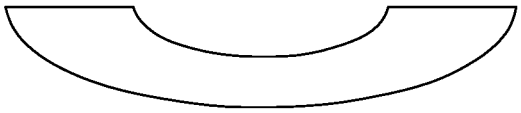
FIG. 4 is a structural diagram of an artificial dam according to another embodiment of the present disclosure.

Preferably, as shown in FIG. 4, the cross section of the artificial dam may also be arc-shaped, wherein the concave of the arc-shaped dam faces the underground reservoir, so as to resist the impact of suddenly-increased water pressure on the dam body.

Preferably, emergency-observing holes 101, 201, 301 are constructed in the support layer 10, the anti-seepage layer 20, and the concrete structure layer 30. In order to avoid damaging the safe operation of the reservoir from suddenly-increased water pressure in the reservoir and thus leading to dam break, the emergency-observing holes are provided in suitable positions in the artificial dam. The emergency-observing holes has one function, i.e. observing and sampling the water pressure, water level and water quality in the reservoir by the holes. In addition, by using a valve with a valve-actuating pressure, in case the water pressure exceeds a valve safety pressure, the valve will be actuated automatically or manually to discharge water, which can ensure the safety of the underground reservoir.

The method for constructing the artificial dam for distributed coal mine underground reservoir according to the present disclosure comprises the steps of:

Step 101: selecting positions for constructing the artificial dam between the security coal pillars 2 in the auxiliary roadway 1;

Step 102: in the auxiliary roadway 1, successively forming the support layer 10 and the anti-seepage layer 20 from inside to outside;

Step 103: abutting the outside of the anti-seepage layer 20, notching in the security coal pillars 2 and the surrounding rocks 3 around the auxiliary roadway 1, to form recesses 33;

Step 104: in the recesses 33, inserting multiple bolts 31 into the security coal pillars 2 and the surrounding rocks 3;

Step 105: embedding the joist steels 32 into the recesses 33;

Step 106: ejecting concrete with high pressure to form the concrete structure layer 30 in the recesses 33.

The depth of the recesses 33 may be 30-80 cm, and the depth can be adjusted 260 depending on neighboring geological conditions and the capacity of the underground reservoir. Specifically, the depth of recesses 33 of the security coal pillars 2 may be 50-80 cm, and the depth of recesses 33 of the surrounding rock 3 may be 30-60 cm. The advantage of the constructing method of the present disclosure is the same as that of the artificial dam, and thus will not be discussed hereinafter.

Preferably, step 101 of selecting the positions for constructing the artificial dam further comprises:

Step 201: prospecting the rock-coal property, stratum, and structure of the roadway to be constructed by using geophysical prospecting and drilling means;

Step 202: selecting locations with simple structure and stable rock-coal property as dam-constructing sites of the artificial dam.

Preferably, before step 102 of "in the auxiliary roadway, successively forming the support layer and the anti-seepage layer from the inside to the outside", the method further comprises:

Step 301: estimating water pressure in the auxiliary roadway 1;

Step 302: setting the shape of the cross section of the artificial dam according to the water pressure.

It is preferable to select an artificial dam with arc-shaped cross section, when the water pressure is relatively high, or when the artificial dam is located in a lower location of the reservoir, so as to resist the water pressure. For arc-shaped artificial dam, the recesses 33 are also formed as an arc.

The above content only describes the principle and the preferred embodiments of the present disclosure. It should be noted that on the basis of the principle of the present disclosure, those skilled in the art can make some variations which also fall into the protection scope of the present disclosure.

The invention claimed is:

1. An artificial dam of distributed coal mine underground reservoir, wherein the artificial dam comprises a support layer, an anti-seepage layer, and a concrete structure layer, which are successively formed in an auxiliary roadway from inside to outside, wherein the concrete structure layer is embedded into security coal pillars and/or surrounding rocks around the auxiliary roadway, emergency-observing holes being provided in the support layer, the anti-seepage layer, and the concrete structure layer, the anti-seepage layer being formed from at least one of gangue and loess, the anti-seepage layer being disposed between the support layer and the concrete structure layer such that the anti-seepage layer fills the space between the support layer and the concrete structure layer.

2. The artificial dam according to claim 1, wherein the concrete structure layer is embedded into the security coal pillars and/or the surrounding rocks in the depth of 30-80 cm.

3. The artificial dam according to claim 1, wherein multiple bolts are provided between the concrete structure layer and the security coal pillars and/or the surrounding rocks.

4. The artificial dam according to claim 3, wherein the length of the bolts is 180-210 cm, and the depth of the bolts inserted into the security coal pillars and/or the surrounding rocks is 30-80 cm.

5. The artificial dam according to claim 1, wherein multiple steel joists are embedded into the concrete structure layer, and the multiple steel joists constitute a shape of "#".

6. The artificial dam according to claim 1, wherein the support layer is a brick and concrete structure layer with a thickness of 1.5 m.

7. The artificial dam according to claim 1, wherein the anti-seepage layer is a gangue structure layer or loess structure layer with a thickness of 2 m.

8. The artificial dam according to claim 1, wherein a cross section of the artificial dam is rectangular or arc-shaped, and a concave of the artificial dam with arc-shaped cross section faces the underground reservoir.

9. A constructing method of an artificial dam for distributed coal mine underground reservoir, wherein the method comprises the steps of:

selecting positions for constructing the artificial dam between security coal pillars in an auxiliary roadway;

in the auxiliary roadway, successively forming a support layer and an anti-seepage layer from inside to outside;

abutting outside of the anti-seepage layer, notching in the security coal pillars and/or surrounding rocks around the auxiliary roadway, to form recesses;

in the recesses, inserting multiple bolts into the security coal pillars and/or the surrounding rocks;

embedding steel joists into the recesses;

injecting concrete with high pressure to form a concrete structure layer in the recesses so that the anti-seepage layer is disposed between the support layer and the concrete structure layer such that the anti-seepage layer fills the space between the support layer and the concrete structure layer; and providing emergency-observing holes in the support layer, the anti-seepage layer, and the concrete structure layer.

10. The method according to claim 9, wherein the step of selecting positions for constructing the artificial dam comprises:

prospecting rock-coal properties, stratums, and structures of roadways to be constructed by using geophysical prospecting and drilling means; and selecting locations with simple structure and stable rock-coal property as constructing sites of the artificial dam.

11. The method according to claim 9, wherein before the artificial dam is constructed, the method further comprises:

estimating water pressure in the auxiliary roadway; and setting a shape of a cross section of the artificial dam according to the water pressure.

* * * * *